United States Patent [19]

Aoki et al.

[11] Patent Number: 4,861,694

[45] Date of Patent: Aug. 29, 1989

[54] PROCESS FOR PRODUCING CARRIERS FOR DEVELOPER

[75] Inventors: Takayoshi Aoki; Masayuki Takeda; Ikutaroh Nagatsuka, all of Kanagawa; Toshio Honjo, Chiba; Kazuhiro Itoh, Chiba; Kenji Uchida, Chiba, all of Japan

[73] Assignee: Hitachi, Ltd., Tokyo, Japan

[21] Appl. No.: 285,383

[22] Filed: Dec. 16, 1988

Related U.S. Application Data

[63] Continuation-in-part of Ser. No. 63,048, Jun. 17, 1987, abandoned.

[30] Foreign Application Priority Data

Jun. 17, 1986 [JP] Japan ..... 61-139182

[51] Int. Cl.[4] ..... G03G 9/10

[52] U.S. Cl. ..... 430/137; 430/108

[58] Field of Search ..... 430/106.6, 108, 111, 430/137

[56] References Cited

U.S. PATENT DOCUMENTS 4,265,992 5/1981 Kouchi et al. ..... 430/106.6

4,526,851 7/1985 Boughton et al. ..... 430/108

*Primary Examiner*—John L. Goodrow

*Attorney, Agent, or Firm*—Antonelli, Terry & Wands

[57] ABSTRACT

A process for producing carriers for a developer is disclosed, which comprises mixing and heating a carrier material containing a binder resin and a magnetic powder, and essentially free of solvent, to obtain a molten dispersion of the magnetic powder in the binder resin; spraying the molten dispersion into liquid droplets; and cooling the droplets to solidify the droplets into carrier particles. The process eliminates the use of solvents and produces carrier particles of superior toughness, surface smoothness, and sphericality.

11 Claims, No Drawings

PROCESS FOR PRODUCING CARRIERS FOR DEVELOPER

This is a continuation-in-part of application Ser. No. 063,048 filed June 17, 1987, now abandoned.

FIELD OF THE INVENTION

The present invention relates to a process for producing a carrier useful as one component of a two-component type developer used in development of electrostatic latent images or magnetic latent images in the electrophotographic method, the electrostatic recording method, the electrostatic printing method, and related processes.

BACKGROUND OF THE INVENTION

In the electrophotographic method, an electric latent image is generally formed by various techniques using a photoconductive substance, e.g., selenium, as a photoreceptor and the latent image is developed by attaching toners thereto, utilizing techniques such as the magnetic brush developing method.

In this developing step, a two-component type developer is most commonly used, in which carrier particles called "carriers" are used in combination with the toners in order to provide a suitable amount of positive or negative electricity. Various types of such carriers have been developed and put into practical use.

The carrier is required to have various characteristics. Particularly important among these characteristics are charging properties, impact resistance, abrasion resistance, developing properties, developer life, environmental independency in charge properties, and stability of charge properties in the passage of time.

In view of the above characteristics, conventional carriers remain inadequate; in fact, no sufficiently satisfactory carrier has yet been produced. For example, electrically conductive carriers, e.g., iron oxide powder, have the disadvantages that fine line reproducibility is poor, although solid developability is excellent, and further that it is necessary for a special charge controlling agent to be added to the toner in order to prolong the service life of the developer. Coated insulating carriers have the disadvantage that solid reproducibility is poor, although service life and reproducibility of fine lines are excellent. In order to overcome the above problems, small particle diameter carriers for magnetic brush development, containing a binder resin and fine magnetic particles dispersed therein, i.e., "microtoning carriers", have been proposed and put into practical use, as disclosed, for example, in U.S. Pat. No. 4,345,014 and Japanese Patent Application (OPI) No. 66134/79. (The term "OPI" as used herein means "unexamined published Japanese patent application.") These carriers, however, still present problems such as adhesion of carriers to a photoreceptor due to their small diameter in size, changes in charging properties under high and low humidity conditions which is caused by magnetic particles freed on the surface, and the further difficulty that since it is difficult to apply surface treatment, it is impossible to dramatically prolong the service life by coating.

It has now been discovered that the above problems of carriers containing fine magnetic particles in the dispersion state are basically caused by the methods of production conventionally used for the carriers.

Heretofore such magnetic powder-containing carriers have been produced either by (1) a method in which a mixture of a binder resin and a magnetic powder is melt kneaded, solidified and then pulverized to obtain carriers having the desired particle diameter, or (2) a method in which a magnetic powder is dispersed in a solution of a binder resin in a solvent, and the resulting dispersion is sprayed to evaporate the solvent at a high temperature (to about 150° C.), thereby producing spherical carriers. Using the first method, it is difficult to produce spherical particles; the magnetic powder is readily freed because of surface irregularity; and it is difficult to attain particle diameters within the desired range. In the second method, since solidification proceeds with evaporation of the solvent, the resulting particle surface is porous and brittle, and coating treatment cannot be applied to the particles obtained.

SUMMARY OF THE INVENTION

The present invention is intended to overcome carriers, and an object of the present invention is to provide a process for producing fine magnetic particle-containing carriers.

Another object of the present invention is to provide a process for producing carriers for magnetic brush development having good surface soiling resistance, causing no reduction in the amount of charge, free from problems such as formation of fog at an early stage and contamination of the inside of a copying machine, and further which are excellent in high speed developing properties and in extending the service life of the developer.

It has now been found that those and other objects can be attained by a process including the steps of (A) mixing and heating a carrier material containing a binder resin and a magnetic powder and essentially free of solvent, to obtain a molten dispersion of the magnetic powder in the binder resin; (B) spraying the molten dispersion into liquid droplets; and (C) cooling the droplets to solidify the droplets into carrier particles.

DETAILED DESCRIPTION OF THE INVENTION

The present invention relates to a process for producing carriers for a developer which comprises melting a mixture containing a binder resin and a magnetic powder as essential components in the absence of a solvent and, thereafter, spraying and cooling the molten mixture.

In connection with toners, the core of microcapsule toners has been produced by the melt spray cooling method, as described in Japanese Patent Application (OPI) No. 187349/84. Since the core of microcapsule toners is a wax-like substance that is protected with a harder shell, severe physical properties, and particularly high strength, are not needed, and for this reason the melt cooling method can be easily applied.

On the other hand, in the case of carriers, since durability is needed, it is difficult to set conditions for melting or cooling, such as melt viscosity and cooling temperature. For this reason the production of carriers by the melt spray cooling method without use of a solvent has not been reported.

In the method of the present invention, as the binder resin which is one of the essential components of the carrier, any thermoplastic resin can be used. Representative examples include homopolymers and copolymers of styrenes such as styrene, chlorostyrene, and vinylstyrene; monoolefins such as ethylene, propylene, butylene, and isobutylene; vinyl esters such as vinyl acetate, vinyl propionate, and vinyl benzoate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Typical binder resins that are useful starting materials in the process according to the present invention include polystyrene, a styrene-acrylic acid alkyl ester copolymer, a styrene-methacrylic acid alkyl ester copolymer, a styrene-acrylonitrile copolymer, a styrene-butadiene copolymer, a styrene-maleic anhydride copolymer, and polyolefins such as polyethylene and polypropylene. In addition, polyesters, polyurethanes, epoxy resins, polyamides, modified rosins, paraffins and waxes can be used.

Preferred among the above compounds are polyesters, and polyolefins having a weight average molecular weight of from about 500 to 20,000, with polyolefins having a weight average molecular weight of from about 500 to 7,000 being particularly preferred since they make it easy to produce almost completely spherical carriers.

As the magnetic powder which is the other essential component of the carrier of the present invention, any conventionally used fine ferromagnetic particles can be used. Representative examples include triiron tetraoxide, γ-diiron trioxide, ferrites, chromium oxide, and metal powders.

The magnetic particle content in the carrier is usually from about 30 to 95 wt % and preferably from about 45 to 90 wt %.

In addition to the binder resin and fine magnetic particles, a charge controlling agent, a dispersion increasing agent, a strength-reinforcing agent, and a coupling agent can be incorporated in the carrier mixture, so long as no substantial amount of solvent is present. The term "solvent" used herein means a compound capable of dissolving the binder resin used in the carrier.

The process for producing carriers according to the invention is now explained in greater detail.

Carriers which are spherical and have excellent surface smoothness can be produced by mixing the above binder resin and fine magnetic particles as essential components and, if desired, other components, melting the mixture by heating, spraying the kneaded material in a molten state as a stream of fine liquid droplets, and solidifying the droplets into fine spherical particles by contacting the droplet stream with a gas or air stream of relatively low temperature. For example, the droplets are cooled by the application of a dry air stream downward or upward thereto.

In more detail, an apparatus for producing the carrier of the present invention comprises a pre-treatment equipment including a heating, melting, and mixing unit and vessel for adjusting the viscosity of the kneaded material, pumps to convey the molten kneaded material to the spraying unit, and cooler to cool and solidify the sprayed kneaded material with a gas or air stream which is preferably introduced in the cooler in such a manner that an eddy is formed in the cooler, whereby adhesion of the produced carrier particles to the wall of the cooler can be prevented.

As the heating, melting, and mixing equipment, any conventional units including a kneader, a roll mill, a Banbury mixer, a sand mill, an attritor, and a Henschel mixer can be used. Of these, a kneader is preferably used, and a pressure or vacuum kneader is particularly preferred for the purpose. As the spraying unit, a nozzle type or disk type unit is suitable for producing carriers having a small particle diameter, although the present invention is not limited thereto.

Factors exerting great influence on the shape and surface properties of the carrier are the viscosity of the kneaded material at the time of spraying, the particle diameter of the magnetic powder, and the cooling temperature. In order to obtain carriers which are spherical and have a relatively high surface smoothness, the viscosity at the time of melting is generally not more than about 10,000 cp at teperatures of from 100° to 250° C. and preferably not more than about 7,000 cp at temperatures of 100° to 230° C.

In connection with the particle diameter of the magnetic powder, the particle diameter is usually not more than about 5 μm and preferably not more than about 2 μm.

The cooling temperature is generally from about 15° to 100° C. and preferably from about 20° to 60° C. At temperatures approaching about 15° C., there is a tendency that for insufficiently spherical particles to be produced.

In view of the service life of the developer and the relationship between adhesion of carriers to the photoreceptor and image quality, the average particle diameter of the carrier particles produced by the process of the present invention is preferably from about 20 to 400 μm and more preferably from about 30 to 200 μm. Particles having a particle diameter falling within the above range can be easily obtained by variations of the spraying conditions well-known in the art, such as by controlling the nozzle diameter of the spraying unit or the speed of rotation of the disk.

The carrier produced by the process of the present invention can be used as a magnetic brush developer for development of an electrostatic latent image in admixture with the toner. Since the carrier produced by the present invention has remarkably improved surface smoothness and is highly spherical, it can be easily subjected to any conventional additional surface treatment or covering treatment, e.g., with a resin, a coupling agent, a surface active agent, a charge controlling agent, or a fine powder.

As the toner that suitably can be used in combination with the carrier produced by the process according to the present invention, any toner commonly used in electrophotographic process, generally containing a binder resin and a colorant dispersed therein, can be used.

The method of the present invention permits production of almost completely spherical carriers. Thus the carrier produced by the present invention has the advantages that fine line image properties are excellent, strength is increased, deterioration does not occur even when the carrier is used for a long time, and since the separation of fine magnetic particles from the carrier surface is decreased, environmental stability is enhanced and more particularly, fluctuation of charge density between summer and winter conditions is small. For these reasons, the process of the invention is greatly superior to the kneaded pulverization method for producing magnetic particle dispersion carriers. Further-more, the present invention provides carriers having excellent surface smoothness, simplifying the coating of various charge controlling agent solutions or dispersions. Accordingly, the process of the present invention produces carriers that are stabilized in charging properties and greatly increased in service life.

The present invention is described in greater detail with reference to the following examples, although it is not to be construed as being limited thereto. Unless otherwise indicated, all parts, percents and ratios are by weight.

EXAMPLE 1

Seventy-five parts of fine magnetic particles (EPT-1000 produced by Toda Kogyo Co., Ltd.; composition: magnetic iron oxide; average diameter 0.35 μm) and 25 parts of polyester (a hydrogenated bisphenol A/-butanediol/fumaric acid condensate; molar ratio 1/2/3; weight average molecular weight 10,000) were heated at 150° C., melted, and kneaded for 20 minutes in a pressure kneader.

After being sufficiently kneaded, the mixture was adjusted in viscosity to 5,000 cp in a viscosity adjusting vessel, sprayed, cooled, and solidified by the use of a disk type spraying apparatus operating at 10,000 rpm wherein the sprayed molten kneaded material (droplets) was cooled by applying a dry air stream of 25° C. downward to the droplets to eddy, and then sieved to obtain spherical magnetic particle dispersion carriers of the present invention, having an average particle diameter of 50 μm.

The apparent density of the carriers was 1.17 g/cm$^3$, and the saturated magnetization was 63 emu/g.

COMPARATIVE EXAMPLE 1

The same composition as used in Example 1 was kneaded in a pressure kneader in the same manner as in Example 1 and, thereafter, pulverized and sieved by the use of a turbo mill and a sieving machine to obtain amorphous magnetic particle dispersion carriers having an average particle diameter of 50 μm.

EXAMPLE 2

Cu-Zn ferrite (produced by Nippon Iron Powder Co., Ltd.) as magnetic powder was ground in a wet ball mill to obtain fine magnetic particles having an average particle diameter of 1.5 μm.

70 parts of the fine magnetic particles and 30 parts of polyethylene (400P produced by Mitsui Petrochemical Co., Ltd.) were heated at 120° C., melted, and kneaded for 20 minutes in a pressure kneader and, thereafter, in the same manner as in Example 1, sprayed, cooled, and solidified and then sieved to obtain spherical magnetic particle dispersion carriers having an average particle diameter of 55 μm.

EXAMPLE 3

Ni-Zn ferrite (produced by Nippon Iron Powder Co., Ltd.) as magnetic powder was ground in an attritor to obtain fine magnetic particles having an average particle diameter of 1 μm. 70 parts of the fine magnetic particles and 30 parts of polyethylene (400P) were heated at 130° C., melted, and kneaded for 25 minutes and, thereafter, in the same manner as in Example 1, sprayed, cooled, and solidified, and then sieved to obtain spherical magnetic particle dispersion carriers having an average particle diameter of 60 μm.

Carriers as obtained in Examples 1 to 3 and Comparative Example 1 were each mixed with toners for a Model FX-7770 copying machine (produced by Fuji Xerox Co., Ltd.) in such a manner that the toner concentration was 3% by weight, to thereby prepare the corresponding developers.

These developers were tested for initial image solid density,. fog density at the background, reproducibility of fine lines, and tested for the same properties (solid density, fog density at the background, and reproducibility of fine lines) of images after 100,000 sheets were run on a bench machine for evaluation, at a photoreceptor speed of 350 mm/sec and a developing magnetic roll speed of 550 mm/sec, using a Model FX-7770 copying machine. In addition, the amount of charge under conditions of high humidity and low humidity was measured.

The results are shown in the following Table.

TABLE

| | Initial performance | | | | After 1 × 10$^5$ runs | | | | | Environmental test | | |
|---|---|---|---|---|---|---|---|---|---|---|---|---|
| Sample No. | Amount of charge generated (μc/g) | Density of solid image | Fog density at background | Reproducibility of fine lines | Amount of charge generated (μc/g) | Density of solid image | Fog density at background | Reproducibility of fine lines | Life (runs) | Under summer conditions (30° C., 80% RH) | Under winter conditions (10° C., 30% RH) | Total evaluation |
| Example 1 | 20 | 1.35 | 0.00 | A | 14 | 1.40 | 0.02 | A | >1 × 10$^5$ | A | A | A |
| Comp. Example 1 | 18 | 1.39 | 0.00 | A | 9 | 1.33 | 0.08 | B | Ca. 5 × 10$^4$ | fogging at[1] background | reduction[2] in density | C |
| Example 2 | 14 | 1.50 | 0.01 | A | 13 | 1.52 | 0.05 | A | >1 × 10$^5$ | A | A | A |
| Example 3 | 13 | 1.41 | 0.00 | A | 13 | 1.35 | 0.02 | A | >1 × 10$^5$ | A | A | A |

A: good
B: fair
C: bad
[1]due to a reduction of the amount of charge generated
[2]due to an increase of the amount of charge generated While the invention has been described in detail and with reference to specific embodiments thereof, it will be apparent to one skilled in the art that various changes and modifications can be made therein without departing from the spirit and scope thereof.

What is claimed is:

1. A process for producing carriers for developers used in electrophotography comprising the steps of (A) mixing and heating a carrier material containing a binder resin and a magnetic powder, said material being essentially free of solvent, to obtain a molten dispersion of the magnetic powder in the binder resin, said dispersion having a viscosity of not more than 10,000 cp and a temperature of from 100° to 250° C.;

(B) spraying the molten dispersion into droplets; and (C) cooling the droplets to solidity the droplets into carrier particles having an average particle diameter from about 30 μm to about 200 μm.

2. A process as claimed in claim 1, wherein said binder resin is a thermoplastic resin that is a homopolymer or copolymer of monomers selected from the group consisting of styrenes, monoolefins, vinyl esters, α-methylene aliphatic monocarboxylic acid esters, vinyl ethers, and vinyl ketones.

3. A process as claimed in claim 1, wherein said carrier contains from about 30 to 95 wt % of said magnetic powder.

4. A process as claimed in claim 3, wherein said carrier contains from about 45 to 90 wt % of said magnetic powder.

5. A process as claimed in claim 1, wherein said magnetic powder has an average particle diameter of not more than about 5 μm.

6. A process as claimed in claim 5, wherein said magnetic powder has an average particle diameter of not more than about 2 μm.

7. A process as claimed in claim 1, wherein the viscosity is not more than about 7,000 cp and the temperature of said molten dispersion is from about 100° to 230° C.

8. A process as claimed in claim 1, wherein the cooling temperature in step (C) is from about 15° to 100° C.

9. A process as claimed in claim 8, wherein the cooling temperature in step (C) is from about 20° to 60° C.

10. A process as claimed in claim 2, wherein said binder resin is a polyester or a polyolefin having a weight average molecular weight of from about 500 to 20,000.

11. A process as claimed in claim 10, wherein said binder resin is a polyolefin having a weight average molecular weight of from about 500 to 7,000.

* * * * *

UNITED STATES PATENT AND TRADEMARK OFFICE

CERTIFICATE OF CORRECTION

PATENT NO. : 4,861,694

DATED : August 29, 1989

INVENTOR(S) : Takayoshi AOKI ET AL.

It is certified that error appears in the above-identified patent and that said Letters Patent is hereby corrected as shown below:

Title page:

[73] Assignee: Delete "Hitachi, Ltd., Tokyo, Japan" and insert --Fuji Xerox Co., Ltd., Tokyo, Japan and Nippon Iron Powder Co., Ltd., Chiba, Japan--

Signed and Sealed this

Second Day of April, 1991

*Attest:*

*Attesting Officer*

HARRY F. MANBECK, JR.

*Commissioner of Patents and Trademarks*